US005259293A

United States Patent [19]

Brunner

[11] Patent Number: 5,259,293

[45] Date of Patent: Nov. 9, 1993

[54] HYDRAULIC CONTROL DEVICE

[75] Inventor: Rudolf Brunner, Baldham, Fed. Rep. of Germany

[73] Assignee: Heilmeier & Weinlein Fabrik fuer Oel-Hydraulik GmbH & Co. KG, Fed. Rep. of Germany

[21] Appl. No.: 832,036

[22] Filed: Feb. 6, 1992

[30] Foreign Application Priority Data

Feb. 21, 1991 [DE] Fed. Rep. of Germany ..... 4105459
Nov. 12, 1991 [EP] European Pat. Off. ..... 91119267.2

[51] Int. Cl.[5] ..... F15B 11/08; F15B 13/04

[52] U.S. Cl. ..... 91/420; 91/426; 91/447; 60/468

[58] Field of Search ..... 91/444, 446, 447, 420, 91/421, 426, 461; 60/460, 461, 466, 468

[56] References Cited

U.S. PATENT DOCUMENTS

| | | | |
|---|---|---|---|
| 4,323,095 | 4/1982 | Acerbi | 91/420 |
| 4,531,449 | 7/1985 | Reith | 91/461 |
| 4,732,076 | 3/1988 | Ewald | 60/460 |
| 4,854,221 | 8/1989 | Tardy | 91/461 |
| 4,953,639 | 9/1990 | Hammer et al. | 60/468 |

FOREIGN PATENT DOCUMENTS

| | | | |
|---|---|---|---|
| 2036547 | 1/1972 | Fed. Rep. of Germany | 91/420 |
| 3733740 | 10/1987 | Fed. Rep. of Germany . | |

OTHER PUBLICATIONS

National Fluid Association, Graphic Symbols For Fluid Power Diagrams Oct. 1967, p. 12.

Pippenger, Fluid-Power Controls, 1959, p. 65.

*Primary Examiner*—Edward K. Look
*Assistant Examiner*—Hoang Nguyen
*Attorney, Agent, or Firm*—Kinzer, Plyer, Dorn, McEachran & Jambor

[57] ABSTRACT

In a hydraulic control device (S) comprising a double-acting hydraulic consumer (V) which is actuable by pressure via two working conduits (4, 5) and secured in at least one working direction by a load holding valve (H) which is hydraulically openable and closable in a controlled way, further comprising a control pressure conduit (12) which is connected to a control connection of the load holding valve and selectively actuable, as well as a damping throttle (13) arranged in control pressure conduit (12), there is provided a valve (15, 15', 15'', 15''', 15$^{IV}$) which during the controlled closing movement of load holding valve (H, 6) is automatically responsive to a delay of the controlled closing movement which is caused by the instantaneous viscosity of the pressure medium and/or a too tight setting of damping throttle (13) and is critical as to the after-running of hydraulic consumer (V) under a load (F), with the valve switching in such a case to passage and bypassing damping throttle (13). The valve offsets the effect of a pressure medium which is too cold, and/or a setting of the damping throttle that is too tight for an intended damping action with respect to a controlled closing of the load holding valve, and it ensures the rapid closing of the load holding valve as is required for stopping and holding the load, in particular during a safety shut-off operation.

11 Claims, 5 Drawing Sheets

FIG.2
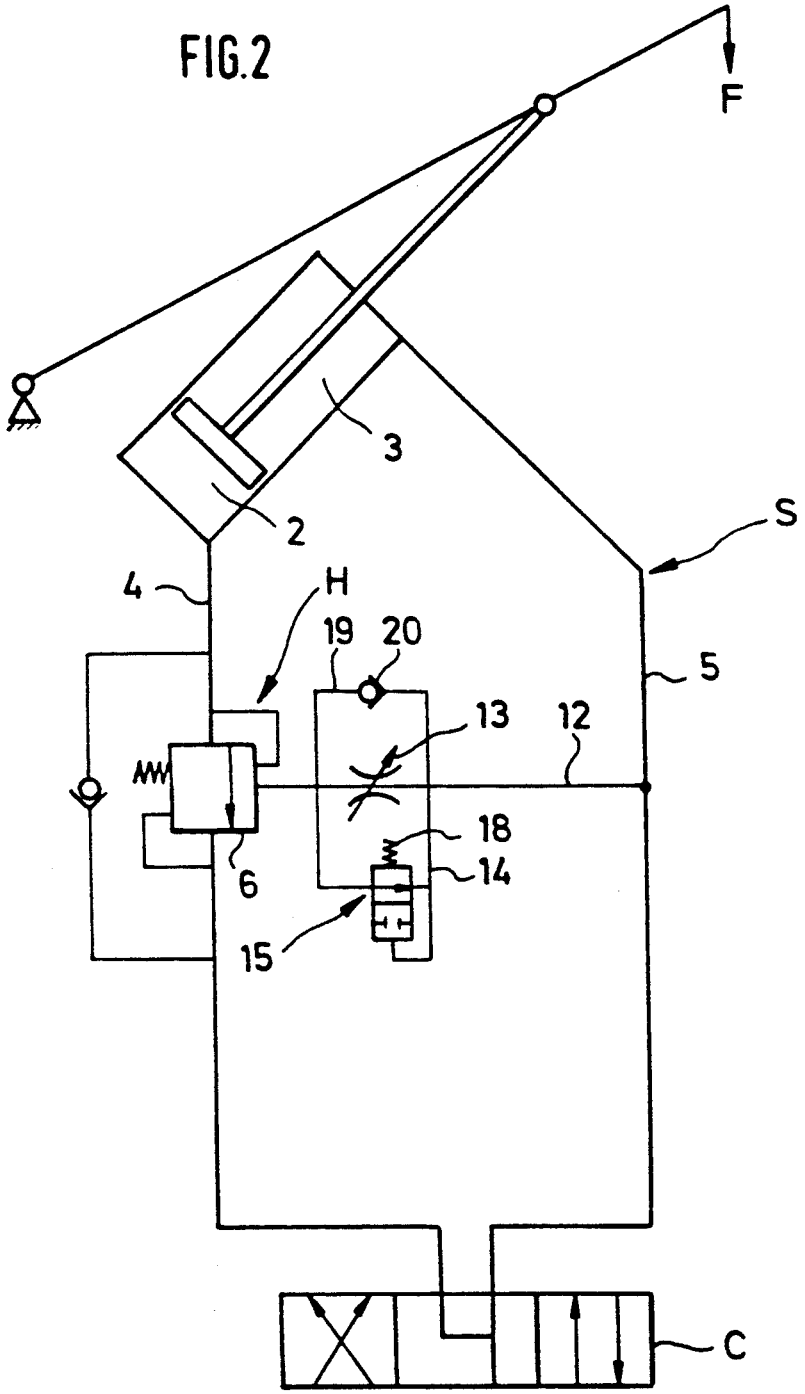
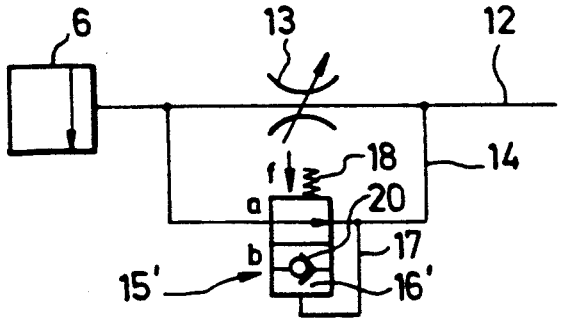
FIG.2A

HYDRAULIC CONTROL DEVICE

DESCRIPTION

This invention relates to a hydraulic control device of the type as outlined in the preamble of claim 1.

In a hydraulic control device as is known from publication 7100, June 1986, pp. 1 and 2, edited by Heilmeier & Weinlein, 8000 München 80, the damping throttle must dampen either the controlled closing movements or the controlled closing and opening movements of the load holding valve so as to dampen pressure variations in the system and thus vibrations of the load. The function of the load holding valve consists in preventing undesired or inadmissible after-running of the hydraulic consumer under load after the consumer has been stopped. Control devices of this type that are equipped with a damping throttle are preferably used when vibratory motions of the hydraulic consumer must be expected, e.g. in lifting or extension cylinders of cranes, in particular vehicular cranes, in rotary piston cylinders or rack/pinion pivot cylinders, in all kinds of lifting and pivoting means with a change in sign of the load direction, in cable-winch or pivot-mechanism drives, or the like. The damping throttle is set such that in the case of an operatively warm pressure medium it optimally dampens pressure variations when the hydraulic consumer is moved under load, with the load holding valve being opened. Within the load holding valve there exists a working play having associated therewith movements of relatively small pressure medium volumes inside the control pressure conduit. These volumes pass through the damping throttle and produce the damping effect in the system. The damping throttle may delay a desired rapid closing movement of the load holding valve for stopping or positioning a load because of a setting of the damping throttle that is optionally thight for achieving optimum damping, and/or in case of a cold pressure medium. As a result, the hydraulic consumer performs a harmful or dangerous after-run movement after stopping under load.

In a control device of this type as is known from DE 37 33 740 A1, a load lowering valve is controlled via two throttle gaps arranged in parallel inside the control pressure conduit of the load lowering valve, with the aid of laminar flow. The two throttle gaps are matched to each other with respect to their straight characteristics such that their summation characteristic substantially follows a desired characteristic line in the working range. The two throttle gaps change their gap height in response to the temperature. A vibration damping operation which is independent of the temperature of the pressure medium is aimed at in this way. This principle is also suited for load holding valves. The gap heights of the two throttle gaps which are also designed for optimum damping in the case of a cold pressure medium cannot exclude after-running of the hydraulic consumer when there exists a load holding valve.

Hydraulic control devices of this type are often integrated into hydraulic systems having a safety shut-off function. This means that the hydraulic consumer, or the components moved thereby, is monitored with respect to a load limit, a load moment limit or a movement limit which must not be exceeded. A limit pressure or limit position sensor generates an electrical signal which opens an electromagnetic valve within the control circuit. This valve reduces an opening pressure for a control means of the control valve of the consumer or for a main control means of the hydraulic system. Further movement of the hydraulic consumer beyond this critical limit is to be prevented by no longer feeding working pressure into this motional direction or by limiting the amount of working pressure medium. However, it often happens that the sensor only responds to this safety limit in an exact way or at best only within a relatively narrow, predetermined range of tolerance. If the consumer exceeds the range of tolerance despite the response from the sensor, e.g. because of after-running of the hydraulic consumer under load, the sensor will no longer respond, and the consumer can be controlled without any restrictions in the critical range as well. In a crane, for instance, this is especially dangerous for the bent cylinder or the horizontal pivot cylinder and can above all be observed, as has been found in practice, with a cold pressure medium or under a strong damping action on account of the damping device which is normally provided for.

It is the object of the present invention to provide a hydraulic control device of the above-mentioned kind wherein despite a damping action for normal operation an undesired after-running of the hydraulic consumer is excluded under load, or to improve a hydraulic control device with safety shut-off with respect to the reliability of its safety function even under adverse conditions.

In accordance with the invention, this object is accomplished through the features specified in the characterizing part of patent claim 1.

If the hydraulic consumer, or rather the load, is to be lowered by releasing pressure medium from the working conduit including the load holding valve, opening pressure is fed into the control pressure conduit and the load holding valve is opened in a controlled way. The valve which is arranged in the conduit loop maintains its shut-off position; the pressure medium passes through the damping throttle and is damped. Whenever the hydraulic consumer is to be stopped, the control pressure conduit is relieved until the load holding valve closes in a controlled way and holds the load. To ensure a satisfactorily quick closing of the load holding valve in case of a cold and thus viscous pressure medium, the valve responds to the resultant pressure difference and assumes its through-position. The pressure medium bypasses the damping throttle. Likewise, in the case of a damping throttle which is optionally tightly set for achieving the desired damping action, and in the presence of an operatively warm pressure medium, the valve responds whenever the hydraulic consumer must be stopped and the load held and the damping throttle would prevent such an action. The responsiveness of the valve is adjusted such that under adverse operating conditions any after-running of the hydraulic consumer is prevented and the damping throttle nevertheless performs a damping action whenever such an action is needed, e.g. when the load is lowered. The control device together with the valve is automatically capable of overruling the damping throttle whenever there is an operative state which is critical with respect to an after-running of the hydraulic consumer. This offers the advantage of a damping throttle which is optimally adjustable for damping and of a rapid response and load holding of the load holding valve in operative states where the damping throttle would interfere with a controlled closing of the load holding valve. In cases where safety shut-off is ensured in the hydraulic system including the hydraulic control device, the hydraulic consumer cannot pass beyond the safety limit or through a safety tolerance range even under adverse conditions.

In the embodiment according to claim 2, the second pressure difference at the valve is so adjusted that it permits the damping throttle to develop its full effect again when the load holding valve has almost reached its load holding position and only a small amount of working pressure medium passes through the load holding valve. The residual closing lift of the load holding valve is again monitored by the damping throttle which is capable of performing an independent damping action in cases where pressure vibrations arise.

In the embodiment of claim 3, the pressure in the control pressure conduit first keeps the valve in the shut-off position when the load holding valve is open, as this pressure overcomes the permanently acting force on the valve. Even with moderate pressure variations, the valve element remains in the shut-off position, so that the damping throttle dampens plays of the load holding valve and pressure variations in the system. If the pressure in the pressure control conduit is reduced by virtue of the damping throttle to such an extent that the permanently acting force moves the valve into the through-position in a controlled manner, a pressure reduction allowing the correct and controlled closing movement of the load holding valve is ensured by the pressure medium which flows off via the valve. Due to the pressure medium which flows off through the damping throttle at any rate, the valve moves under normal operation only into the through-position—if at all—in cases where after-running of the hydraulic consumer must be feared. By contrast, when there are excessive pressure variations, the valve can also be moved in a controlled way into the through-position for a short period, thus supporting the damping action of the damping throttle by reducing pressure peaks. The permanent force, however, will immediately move it back into the shut-off position.

The embodiment according to claim 4 is of simple construction. The pressure difference between the opening pressure and the resilient force on the valve element is passed across the damping throttle at any rate. The responsiveness of the valve is adjusted through a selection of this pressure difference, whereby the damping throttle is mainly made to operate at moderate pressure variations inside the system, while the damping throttle is automatically ignored to the necessary extent when a reliable stopping of the hydraulic consumer becomes necessary, i.e. also under load and in the presence of a cold pressure medium.

The feature of claim 5 is also of importance because a slide valve works in an oil leakage-tight and relatively temperature-independent way without calling for any great constructional efforts.

In the embodiment of claim 6, the biased closing check valve works at an elevated pressure window during movement of the hydraulic consumer, also under load, i.e., as soon as the pressure difference across the damping throttle becomes greater than the permanent force acting on the check element, the pressure medium will flow off past the damping throttle until the pressure difference has decreased to such an extent that the permanent force closes the closing check valve again and the remaining pressure medium must flow from the opening side of the load holding valve across the damping throttle. A desirable effect is here that the load holding valve rapidly closes in a vigorous movement and substantially stops the hydraulic consumer before the load holding valve moves into its closing end position in a subsequent and damped residual-lift movement, with the passage in the working conduit being already more or less throttled in the working conduit. Hence, pressure variations are not only suppressed or damped, but the load holding valve closes in a controlled way (especially in the case of a safety shut-off operation) quite reliably and independently of the operating conditions (also with a cold pressure medium) and so swiftly that there is no after-running of the hydraulic consumer beyond a safety limit or through a safety tolerance range.

The embodiment of claim 7 has turned out to be useful in practice. With such an adjustment, after-running of the hydraulic consumer under load is prevented even in the case of a cold pressure medium and/or tight setting of the damping throttle.

In the embodiment of claim 8, the relatively strongly biased closing check valve permits a substantially undisturbed action of the damping throttle because it becomes only effective if there arises the risk of an inadmissible after-running of the hydraulic consumer, and it immediately shuts off again when this risk has been eliminated after a strong and controlled closing movement of the load holding valve.

Another advantageous embodiment becomes apparent from claim 9. Especially in vehicular cranes, strong vibrations of the load can be observed in practice. These vibrations may cause long-lasting pressure variations within the system and make the operation of the crane more difficult. The damping effect of the movement damping throttle will then no longer be satisfactory. Owing to the bypass channel and the disturbance throttle passage arranged therein and to the throttle passage cooperating therewith in the control pressure conduit, an additional hydraulic damping device is incorporated into the control circuit of the load holding valve for the purpose of damping pressure variations very effectively and rapidly, as the amount of pressure medium flowing off via the bypass conduit interferes with the amplitudes of the pressure variations to such an extent that the pressure variations will soon decay. The inclusion of the different pressures (which will then prevail in the control circuit of the load holding valve) in the precontrol of the valve which is subjected to the permanent force offers the advantage cf an immediately closed load holding valve even under critical operating conditions (cold pressure medium and/or tightly set movement-damping throttle).

The permanently acting force may be relatively small in the embodiment of claim 10 because it is supported by the pressure in the bypass conduit. This improves the response characteristics of the valve. Since the valve participates in the damping of pressure variations, this has the additional advantage that the difference in size between the throttle passage and the disturbance throttle passage may be very small, whereby the amount of pressure medium flowing off via the bypass conduit can be kept desirably small.

The feature in claim 11 is also of importance, for the volume flow required for the damping and pressure precontrol of the valve must actually be able to flow off via the bypass channel so as to contribute to the damping action. If a control valve which in the zero position establishes a connection of the two working conduits, or the working conduit containing the load holding valve, to the tank is integrated into the hydraulic control device, the bypass conduit is expediently connected to this conduit. Alternatively, the bypass conduit may also be directly guided to the tank. In such a case a directional control valve with a blocked zero position may also be used. Moreover, a directional control valve with inflow controllers may be used because of the effective damping action, which valve is per se risky for vibration-prone control devices because it has normally a rather long transient response.

Furthermore, the embodiment of claim 12 is expedient because the bypassing check valve for controlled opening allows a prompt controlled opening of the load holding valve, which is desired for some applications, by bypassing the damping throttle. In case of pressure variations during the movement of the hydraulic consumer, this check valve is kept closed by the pressure in the control pressure conduit at any rate, so that the control pressure medium must flow across the damping throttle.

A constructionally simple embodiment follows from claim 13. The check valve is integrated into the valve and guarantees a controlled opening of the load holding valve without delay.

The embodiment of claim 14 is characterized by an especially effective damping of pressure variations inside the system. The operation of the closing check valve is favorably influenced by the pressure accumulator.

Furthermore, the embodiment of claim 15 is expedient. The check valve provided at this point prevents control pressure medium from flowing off to the other working conduit, or pressure variations in the control pressure circuit from propagating into the other working conduit. Furthermore, the check valve forces the pressure medium, also from the pressure accumulator, to flow off via the bypass channel for the purpose of an effective damping action.

The embodiment of claim 16 is of an independent and special significance because the simple safety shut-off device cannot be tricked even under adverse operating conditions, such as a cold pressure medium or a strong damping action with a tightly set damping throttle, but the load holding valve closes without any noticeable after-running as is desired. At a safety shut-off point the closing check valve is biased less strongly, whereas is may be biased to a greater degree within a safety shut-off tolerance range. The reliablity of the safety shut-off action is also ensured under conditions that are specifically adverse to a safety shut-off action, but quite correct for normal operation.

The embodiment of claim 17 provides for a simple structure of the safety shut-off device because each sensor, just like the relief valve, merely requires an electrical power supply means that can be easily accommodated. The relief valve has a small size and can be integrated without any problem into the directional control valve or the control means.

In all of the above-described embodiments the valve as well as the additional components could directly be installed in the block of the load holding valve. However, it is also possible to mount a unit on the load holding valve—so to speak as a retrofit unit, or to arrange it at another place inside the control circuit of the load holding valve and to modify or retrofit a control device which was already in operation or designed previously.

Embodiments of the subject matter of the invention shall now be explained with reference to the drawing, in which FIG. 1 shows a diagram of a control device, in load holding position;

FIG. 2 shows a modified embodiment of a control device, in load holding position;

FIG. 2*a* shows a variant of a detail with respect to FIG. 2;

FIG. 3 shows another embodiment of a control device;

FIG. 3*a* shows a variant of a detail with respect to FIG. 3;

Figure 1:
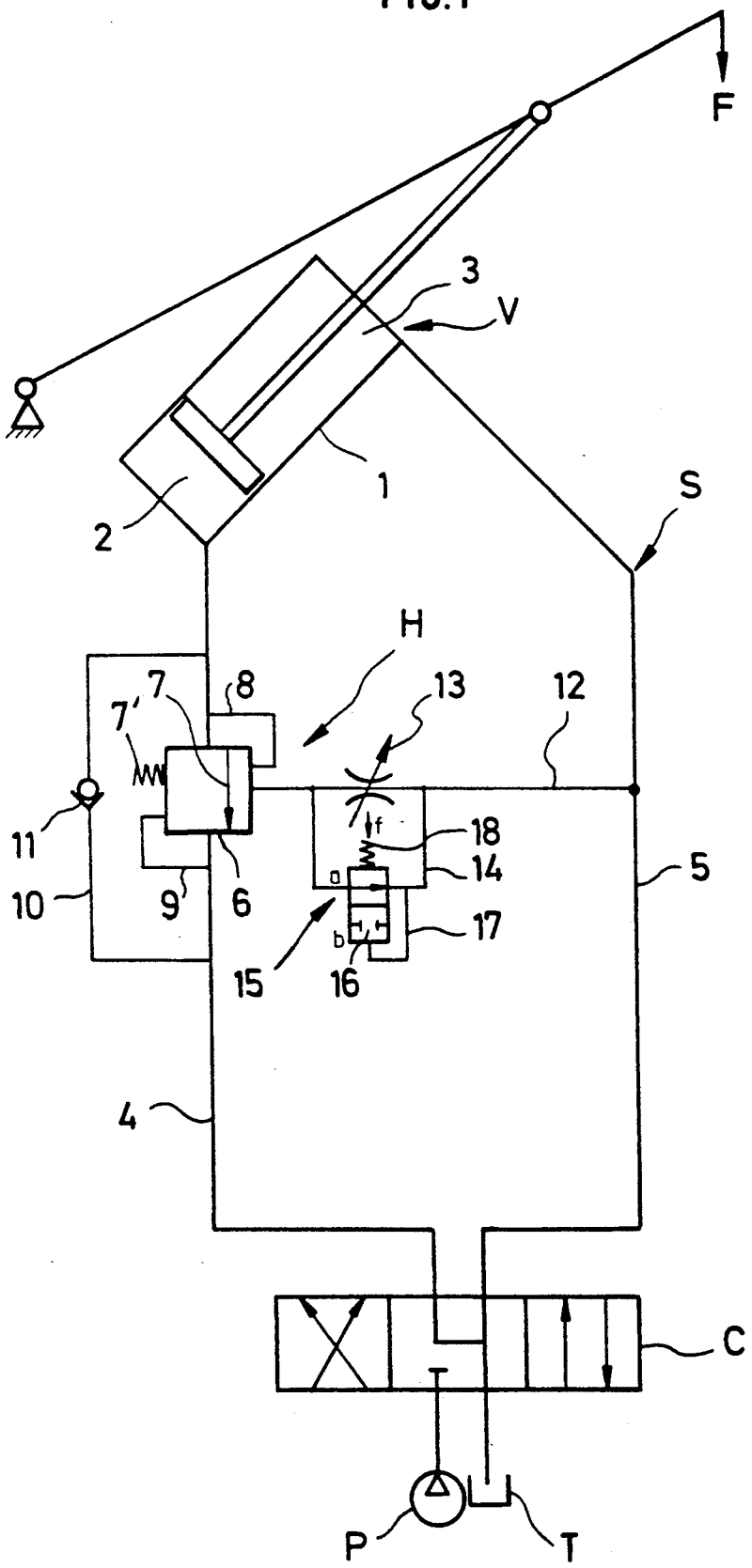

A hydraulic consumer V, e.g. a double-acting hydraulic cylinder for moving a load arm carrying a load F, e.g. as a bent cylinder of a vehicular crane, can be seen in a hydraulic control device S as illustrated in FIG. 1. The cylinder which includes two chambers 2, 3 that are separated by a piston is supplied with pressure medium from a pressure source P from a tank T. A control valve C is provided for controlling the hydraulic consumer. In the illustrated embodiment, this is a 4/3-way control slide with a relieved zero position. Chambers 2, 3 of hydraulic consumer V are connected to control valve C via working conduits 4, 5. When pressure acts on working conduit 4, load F is lifted and pressure medium is discharged through the other working conduit 5. When pressure acts on the other working conduit 5, hydraulic consumer V is moved (lowered) under load F, with pressure medium being discharged through working-conduit 4. The one working conduit 4 has disposed therein a load holding valve H which serves to hold load F, e.g. in the zero position of control valve C. Load holding valve H is provided in the conventional way with a valve 6 which is continuously adjustable between a through-position relative to control valve C and a shut-off position and comprises a valve member 7 including an opening piston (not shown). Valve member 7 is loaded by a spring 7' in the closing direction (as shown). Furthermore, a precontrol pressure derived via a control conduit 9 is active in the closing direction at the side of control valve C. By contrast, in the opening direction the precontrol pressure is active in a control conduit 8 branched from working conduit 4 between valve 6 and hydraulic consumer V. Furthermore, there is provided a control pressure conduit 12 whose pressure acts on valve member 7 in the opening direction and which branches from working conduit 5 in the present embodiment. However, it would also be possible to supply the pressure in control pressure conduit 12 from a separate pressure source or pressure control device.

Load holding valve H is bypassed (for lifting purposes) by a bypass channel 10 with a check valve 11 opening towards hydraulic consumer V.

An adjustable damping throttle 13 which during the downward movement of load F dampens pressure variations and, in this embodiment, the controlled opening and closing movements of valve 6 is included in control pressure conduit 12. A conduit loop 14 bypasses damping throttle 13 in control pressure conduit 12. Conduit loop 14 has arranged therein a valve with a valve element 16, in FIGS. 1-3*a*, a 2/2-way slide valve which is reversible between a through-position a and a shut-off position b. Valve element 16 is acted upon by a permanent force f of an expediently adjustable spring 18 towards through-position a. By contrast, valve element 16 is acted upon towards its shut-off position b by the pressure in a precontrol conduit 17 which branches from conduit loop 14 between valve 15 and the other working conduit 5.

Force f is somewhat smaller than the force acting on valve element 16 through the (opening) pressure in precontrol conduit 17.

To lower load F, working conduit 5 is acted upon by pressure by means of control valve C. Since check valve 11 shuts off, valve 6 must be opened in a controlled way. This is accomplished via control pressure conduit 12 and damping throttle 13. The pressure in control pressure conduit 12 holds valve 15 in shut-off position b via precontrol conduit 17, so that the pressure medium passes across damping throttle 13 for a controlled opening operation. If pressure variations are lateron observed in the system during the lowering movement, valve 15 remains in its shut-off position, at least in the case of moderate pressure variations. Within the range of the working play of valve 6 (e.g. a few 1/10 mm), the pressure medium is dampened by damping throttle 13.

If load F is to be stopped, the pressure in the other working conduit 5 and thus in control pressure conduit 12 is relieved. If the pressure at valve member 7 cannot be relieved quickly enough for the controlled closing of said member via damping throttle 13, spring 18 presses valve element 16 into through-position b in which damping throttle 13 is bypassed via conduit loop 14 and valve 6 switfly closes. Any after-running of hydraulic consumer V is thereby prevented. Valve 15 becomes effective in the above-described way whenever damping throttle 13 delays the controlled closing movement because of the viscosity of a cold pressure medium, or whenever damping throttle 13 is very tightly set for reasons of a sufficient damping action. Furthermore, when there are excessive pressure variations in control pressure conduit 12, valve 15 can be switched to passage for a short period of time so as to take part in the damping action and to pass pressure peaks. Even before the pressure in control pressure conduit 12 is fully relieved, spring 18 moves valve 15 into the shut-off position. The residual pressure is relieved via damping throttle 13. Valve 15 fulfills this auxiliary closing function in the same way as with an elevated pressure window.

Control device S as illustrated in FIG. 2 differs from the embodiment shown in FIG. 1 by an additional conduit loop 19 of control pressure conduit 12 in which a check valve 20 opening towards valve 6 in a controlled way is arranged to prevent any delay during the controlled opening of valve 6. In case of pressure variations during the lowering movement check valve 20 is kept in the shut-off position, so that moving amounts of control pressure medium pass through damping throttle 13. The other function of control device S in FIG. 2 corresponds to that as shown in FIG. 1.

In the embodiment illustrated in FIG. 2*a*, check valve 20 is constructionally integrated into valve 15' and valve element 16' thereof. The function is the same as in the embodiment illustrated in FIG. 2.

Figure 3:
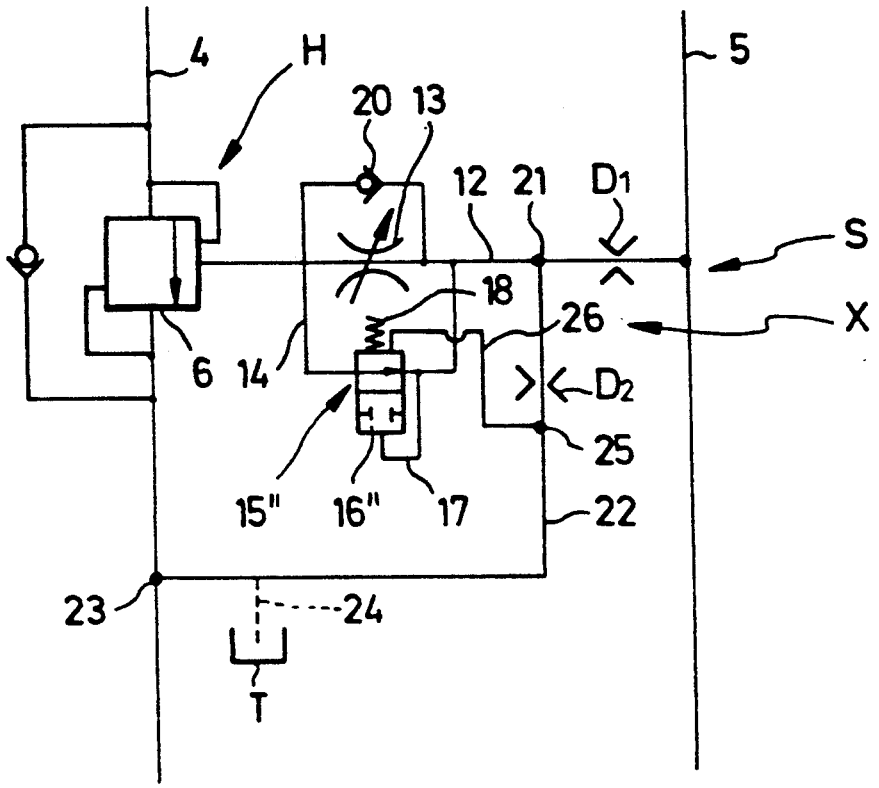

Control device S according to FIG. 3 differs from the embodiment of FIG. 2 by an additional damping device X for pressure variations in the system. Damping device X is formed by a throttle passage D1 in control pressure conduit 12 and a bypass conduit 22 which branches from control pressure conduit 12 at 21 and contains a disturbance throttle passage D2. Disturbance throttle passage D2 is greater than throttle passage D1. Bypass conduit 22 is either connected to working conduit 4 (at 23) or, as outlined by the broken line at 24, directly coupled with tank T, so that when working conduit 5, and thus control pressure conduit 12, is under pressure, pressure medium constantly flows off via bypass conduit 22. The series-connected passages D1 and D2 have an additional damping effect on pressure variations when control pressure medium flows off.

In the opening direction, damping throttle 13 is bypassed by check valve 20. Conduit loop 14 has arranged therein valve 15'' with its valve element 16'' that ensures the swift closing of valve 6 also under adverse operating conditions (cold pressure medium and/or tight setting of damping throttle 13). Valve element 16'' is loaded by spring 18 with the permanent force and the pressure in a precontrol conduit 26 towards through-position a. Downstream of disturbance throttle passage D2, precontrol conduit 26 is branched from bypass conduit 22. Valve element 16'' is urged towards shut-off position b via precontrol conduit 17 from control pressure conduit 12, namely with the pressure prevailing between junction 21 of bypass conduit 22 and damping throttle 13. Force f which is adjusted by means of spring 18 may be relatively small in this embodiment because spring 18 is supported by the pressure in precontrol conduit 26. At an opening pressure of 20 bar which is necessary at valve 6, the setting of spring 18 to a pressure value of 15 bar is sufficient to ensure the swift closing of valve 6 without any after-running in the case of a cold pressure medium and/or a movement damping throttle 13 which is set too tightly. Since valve 15'' supports the damping of pressure variations, disturbance throttle passage D2 need only be slightly greater than throttle passage D1, whereby the amount of the pressure medium flowing off via bypass conduit 22 is kept small in a desirable way.

The function of control device S according to FIG. 3 corresponds substantially to that in FIG. 2.

Figure 3A:
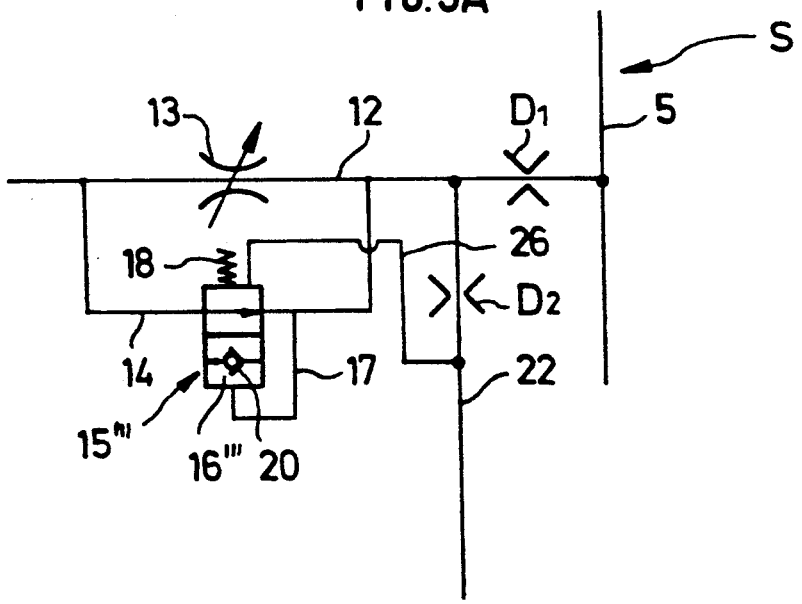

In the modified embodiment shown in FIG. 3*a*, check valve 20 as shown in FIG. 3 is constructionally integrated into valve element 16'''of valve 15'''. The pressure precontrol of valve 15'''is carried out in the same way as in FIG. 3.

Valve 15, 15', 15'', 15''', need not necessarily be a slide valve though this has the advantage of a virtually leakage oil-free operation. The desired function can also be accomplished with a seat valve or an openable check valve with bias.

Furthermore, it is possible to construct valve 15, 15', 15'', 15''', in such a way that it can be actuated by a magnet and is operated by remote control through a thermostat or a pressure control device whenever the pressure medium is e.g. cold or the pressure prevailing at the opening side of valve 6 rises too much because of delayed relieving or because it is not reduced rapidly enough.

Figure 4:
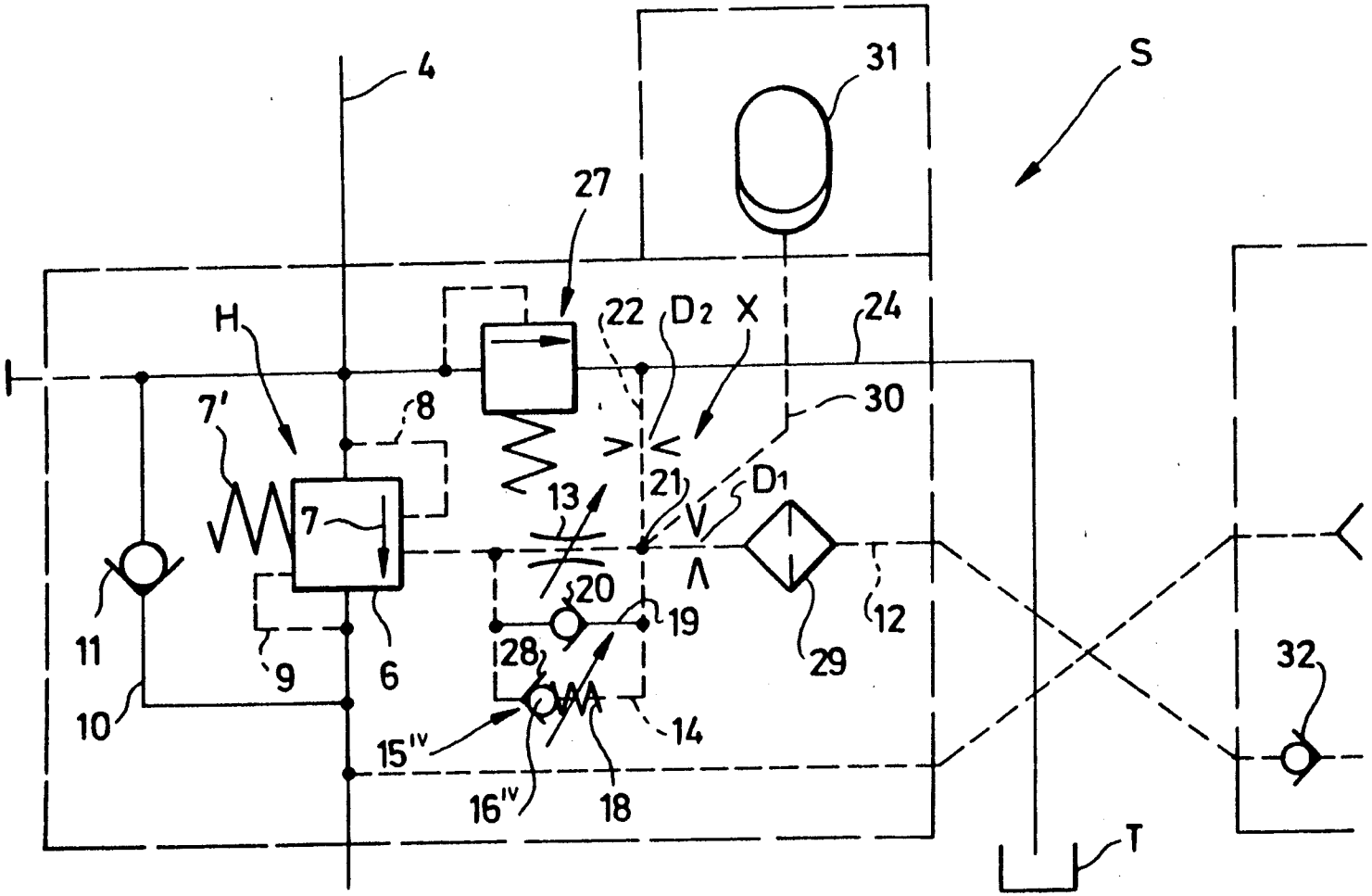
FIG. 4 shows another embodiment.

In the embodiment of FIG. 4 the hydraulic control device comprises a closing check valve as valve $15^{IV}$ which bypasses damping throttle 13 in the flow-off direction from valve 6. Check element $16^{IV}$ of said check valve is biased by the bias-adjustable spring 18 towards a seat 28. The closing check valve opens against the permanent force f of spring 18 in the flow-off direction from valve 6. Spring 18 is set at a bias value which is slightly smaller than the value of the force which acts through the opening pressure on check element $16^{IV}$. At an opening pressure of about 40 bar, the force of spring 18 corresponds to at least 15 bar and is expediently at about 25 bar. The function of control device S is equal to the function of the embodiment shown in FIG. 3. However, it is also possible to omit check valve 20 in the second conduit loop 19. The function of control device S according to FIG. 4 would then correspond to that of the embodiment shown in FIG. 1, except for the feature that the damping device X is additionally provided for in FIG. 4.

Unlike the embodiment shown in FIG. 3, bypass channel 22 of damping device X is connected to a return conduit 24 which leads directly to tank T. The one working conduit 4 is here also connected to said return conduit via a pressure relief valve 27. Furthermore, a filter 29 is arranged in control pressure conduit 12. Moreover, a check valve 32 which shuts off towards the other working conduit 5 is arranged at the side of control pressure conduit 12 facing the other working conduit 5 (not shown). Furthermore, a pressure accumulator 31 is additionally coupled at connecting point 21 via a conduit 30. Damping device X, including pressure accumulator 31, could also be omitted. Moreover, it is possible to provide damping device X without a pressure accumulator 31.

If control pressure conduit 12 for closing load holding valve H is not acted upon by pressure, check valve 32 shuts off. The pressure in control pressure conduit 12 is released via bypass conduit 22 into return conduit 24. If the pressure difference increases across damping throttle 13, e.g. because of a cold pressure medium or a tight setting of damping throttle 13, to such an extent that the controlled closing movement of valve 6 would be delayed, force f of spring 18 is overcome and the check valve for controlled closing is opened. Valve element 7 of valve 6 of load holding valve H performs a strong lift in the closing direction until valve element 7 is almost in the closed end position. The load and the hydraulic consumer come to a stop. Only a negligible amount of working pressure medium, if any, will now flow off through valve 6. Spring 18 brings check element $16^{IV}$ again into contact with seat 28 after the pressure difference has decreased accordingly across damping throttle 13. The control pressure medium is forced across damping throttle 13 via the remaining lift of valve element 7. The controlled closing movement of valve 6 takes place in two phases following each other in a harmonious way, the first, longer phase being effected by the closing check valve and the second, shorter phase by damping throttle 13. Any marked after-running of the hydraulic consumer is here not observed. The response characteristics of the load holding valve can more or less be adjusted during closing by means of the closing check valve in such a way that the damping throttle which is required for damping and also set for optimum damping is not overruled under adverse operating conditions which possibly cause after-running. This is of special advantage when e.g. in a safety circuit after-running of the hydraulic consumer or the components actuated by the consumer is to be prevented or only tolerated to an exactly defined extent.

Figure 5:
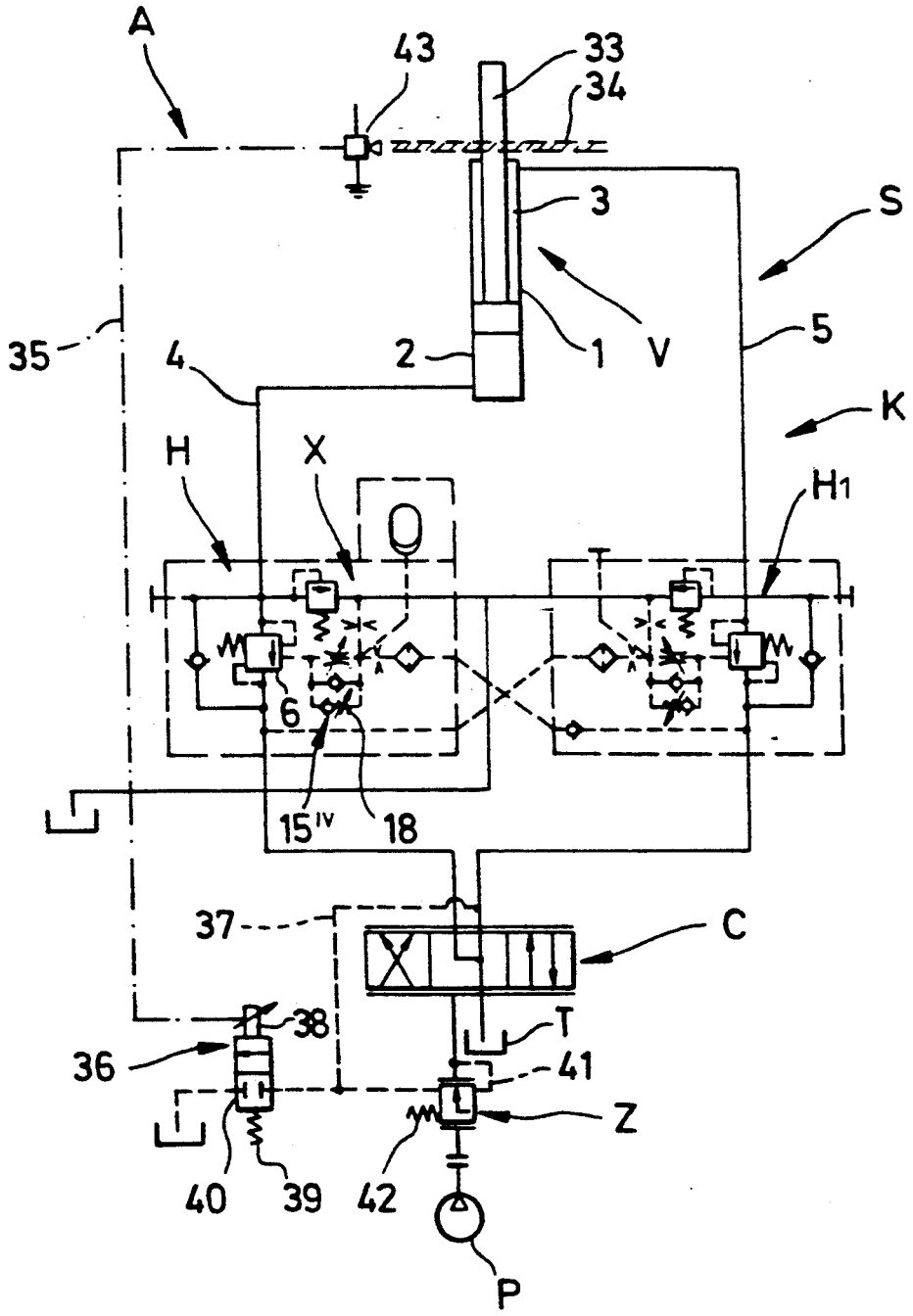
FIG. 5 shows a hydraulic control system with a safety shut-off device.

FIG. 5 illustrates the incorporation of the hydraulic control device S in a hydraulic system K, e.g. a crane, which comprises a safety shut-off device A. The safety shut-off device A prevents further movement of hydraulic consumer V at a load limit, a load moment limit or a movement limit in the direction in which it has reached said limit. Hydraulic consumer V in FIG. 5 is, e.g., the bent cylinder of a crane. A reference point 33 which is outlined at consumer V must not pass beyond a limit depicted by a hatched area 34. Instead of a motional limit, a pressure or moment limit could also be monitored. A sensor 43 senses reference point 33 and generates a signal as soon as point 33 reaches area 34. The signal would no longer be output if area 34 was left again by point 33 in the one or other direction.

Working conduits 4 and 5 are connected to control valve C which is constructed as a directional control valve and which is supplied by pump P with pressure medium and simultaneously connected to a tank T. A control means, e.g. in the form of an inlet controller Z which supplies the pressure medium amount required for perfectly controlling consumer V to control valve C in response to the load pressure is arranged at the inlet side of control valve C. To this end, control means Z is acted upon in the closing direction via a precontrol conduit 41 with the pressure upstream of control valve C, while it is acted upon in the opening direction via a control line 37 with the load pressure in working conduit 5 and by a control spring 42. This is the conventional pressure balance principle.

Instead of an inlet controller, control means Z could also be formed by a main controller which in the presence of several consumers supplied by the same pump P regulates the inlet-pressure or flow rate in a common supply conduit in response to the greatest demand or the priority of a selected consumer.

A relief valve 36 which is expediently designed as an electromagnetic valve with a solenoid 38 and a shut-off position spring 39 for a valve element 40 is arranged in control conduit 37. Solenoid 38 receives the signal in conduit 35 from sensor 43 and relieves control conduit 37 as soon as point 33 has entered area 34. Control means Z interrupts the further supply to control valve C. The pressure in working conduit 5 is no longer increased. When safety shut-off device A responds, load holding valve H, which is shown at the left side in FIG. 4, must therefore be closed so swiftly that hydraulic consumer V is not subject to any after-running during which point 33 passes beyond area 34. Valve $15^{IV}$ of the left load holding valve H is adjusted with its spring 18 such that it ensures a swift closing of load holding valve H which is matched to area 34.

Load holding valve H1, which is shown at the right side in FIG. 5, serves load holding purposes in the other motional direction of hydraulic consumer V. Although this is not shown in FIG. 5, said motional direction of consumer V could also be monitored by a safety shut-off device A. In this case the one working conduit 4 would also have to be brought into pressure-control communication with control means Z.

I claim:

1. A hydraulic control device (S) comprising a double-acting hydraulic consumer (V) which is actuable by pressure via two working conduits (4,5) and secured in at least one working direction by a load holding valve (H, H1) which is adapted to be hydraulically openable and closable in a controlled way, a control pressure conduit (12) which is connected to a control connection of said loading holding valve (H) and adapted to be selectively actuable, and a damping throttle (13) in said control pressure conduit (12), characterized in that said control pressure conduit (12) has disposed therein in parallel with said damping throttle (13) a valve (15, 15', 15'', 15''', $15^{IV}$) which during the controlled closing of said load holding valve (H) is automatically reversible, in response to pressure, from a shut-off position (b) to a through-position (a) at a predetermined, viscosity—in order to eliminate impermissible alternative language adjustment-dependent first pressure difference at said damping throttle (13), said control pressure conduit (12) having disposed therein a conduit loop (14) which bypasses said damping throttle (13) and has arranged therein said valve (15, 15''', 15''', $15^{IV}$) which is designed as a closing check valve and which comprises a valve element (16, 16', 16'', 16''', $16^{IV}$) adapted to be moved between said through-position (a) and said shut-off position (b) and that said valve element (16, 16', 16'', 16''', $16^{IV}$) adapted to be moved between said through-position (a) and said shut-off position (b) and that said valve element (16, 16', 16'', 16''', $16^{IV}$) is acted upon towards its shut-off position (b) by the opening pressure prevailing in said control pressure conduit (12) at the side of said damping throttle (13) facing away from said load holding valve (H), and towards its through-position (a) by a permanent force (f) which is adjusted to a value below the value of the force of the opening pressure of said load holding valve (H) acting on said valve element, and said force (f) being limited to a value which is 10% to 50% smaller than the value of the force of the opening pressure required in said control pressure conduit (12) between said damping throttle (13) and said load holding valve (H) for opening said load holding valve, and that said check element ($161^{V}$) is elastically biased towards its shut-off position by a permanent force (f) which is set to a value below the value of the force of the opening pressure of said load holding value (H) acting on said check element ($161^{V}$), and wherein at an opening pressure of from 35 to 40 bar said spring (18) is set to a force value corresponding to about 25 bar at said check element ($161^{V}$).

2. A hydraulic control device according to claim 1, characterized in that said valve (15, 15', 15'', 15''') is a slide valve comprising a piston slide forming said valve element (16, 16', 16'', 16''').

3. A hydraulic control device according to claim 1, characterized in that a throttle passage (D1) is arranged in said control pressure conduit (12) at the side of said damping throttle (13) which faces away from said load holding valve (H), and that a bypass conduit (22) branches from said control pressure conduit (12) between said throttle passage (D1) and said damping throttle (13) with a disturbance throttle passage (D2) greater than said throttle passage (D1).

4. A hydraulic control device according to claim 3, characterized in that said valve element (16'', 16''') of said valve (15'', 15''') is acted upon towards its shut-off position (b) by the pressure prevailing in said control pressure conduit (12) between said damping throttle (13) and said throttle passage (D1) and is acted upon towards its through-position (a) by said permanent force (f) and by the pressure prevailing in said bypass conduit (22) downstream of said disturbance throttle passage (D2).

5. A hydraulic control device according to claim 3, characterized in that said bypass conduit (22) is connected to said one working conduit (4) including said load holding valve (H), or directly to a tank (T).

6. A hydraulic control device according to claim 5, characterized in that there is provided an opening check valve (20) which bypasses said damping throttle (13) in flow direction towards said load holding valve (H).

7. A hydraulic control device according to claim 6, characterized in that said opening check valve (20) is constructionally integrated into said valve (15', 15'''), preferably in the valve element (16', 16''') thereof.

8. A hydraulic control device according to claim 5, characterized in that a pressure accumulator (31) is connected to said control pressure conduit (12) between said throttle passage (D1) and said damping throttle (13).

9. A hydraulic control device according to claim 8, characterized in that a check valve (32) which shuts off in flow direction relative to said other working conduit (4) is provided in said opening pressure conduit (12) between said throttle passage (D1) and said other working conduit (4).

10. A hydraulic control device according to claim 9, characterized in that said working conduits (4, 5) are connected to a control valve (C), a directional control valve, which at the inlet side is actuable by working pressure medium via a control means (Z), preferably in response to the respective demand, that a safety shut-off device (A) is provided with at least one lift, load moment or load pressure sensor (43) and at least one relief valve (36) for said control means (Z), and that said permanent force (f) on said valve element (16, 16', 16'', 16''') and said check element ($16^{IV}$), respectively, is matched to said opening control pressure of said load holding valve (H), the setting of said damping throttle (13) and the response characteristics of a safety shut-off device (A) in such a way that said load holding valve (H) is moved into its load holding position when said safety shut-off device (A) responds.

11. A hydraulic control device according to claim 10, characterized in that said sensor (43) is designed as an electric or electronic sensor, and said relief valve (36) as an electromagnetic valve which is operated by said sensor (43).

* * * * *